US005168000A

United States Patent [19]

Reinhard et al.

[11] Patent Number: 5,168,000

[45] Date of Patent: Dec. 1, 1992

[54] FLAT TEXTILE BODY

[75] Inventors: Ruedi Reinhard, Weggis; Michael Dorn, Frick, both of Switzerland

[73] Assignee: Textilma AG, Hergiswil, Switzerland

[21] Appl. No.: 499,370

[22] Filed: Jul. 20, 1990

[30] Foreign Application Priority Data

Oct. 4, 1988 [CH] Switzerland ..... 3700/88-5

[51] Int. Cl.[5] ..... B32B 23/02; D03D 3/00; D03D 49/62; D04B 1/00

[52] U.S. Cl. ..... 428/193; 428/95; 428/194; 428/232; 139/189; 139/384 R; 139/408; 139/430; 66/190

[58] Field of Search ..... 428/193, 232, 192, 194, 428/92, 95; 139/189, 384 R, 408, 409, 430; 66/189, 190, 196

[56] References Cited

U.S. PATENT DOCUMENTS 2,443.358 6/1948 Michaelis ..... 2/278
2,813.550 2/1956 Baumgartner ..... 139/189
2,985.941 5/1961 Riedesel et al. ..... 428/193 X
3,773,606 11/1973 Worcester, Jr. et al. ..... 428/193
3,928,694 12/1975 Reinhard ..... 428/92

FOREIGN PATENT DOCUMENTS 521114 4/1972 Switzerland .
546564 3/1974 Switzerland .
589908 7/1947 United Kingdom .

*Primary Examiner*—George F. Lesmes
*Assistant Examiner*—Terrel Morris

[57] ABSTRACT

A flat textile body is composed of adjacent bands (2) that extend in a perpendicular direction to its main center-plane (M). Each band has marginal sections (4) made of woven or knitted warp (6) and weft threads (8). Between the marginal sections at least most of the weft threads are floating threads. Adjacent marginal sections (4) of adjacent bands (2) are not linked to each other by purely mechanical means, i.e. glued or soldered. The resulting flat body is easy to produce in a precise manner and is very versatile. In particular, it can be cut along its main center-plane (M) into two symmetrical pile carpet plates.

8 Claims, 5 Drawing Sheets

FLAT TEXTILE BODY

Figure 1:
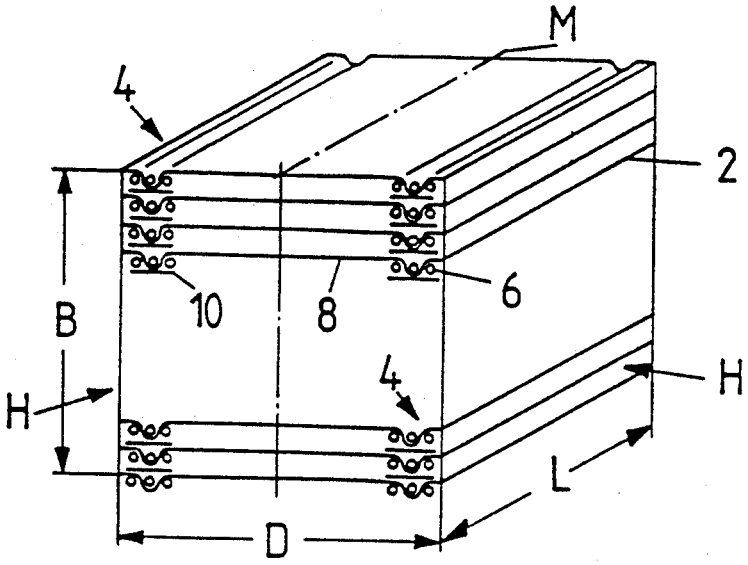

The invention concerns a textile flat body as well as a pile carpet panel made from the flat body as well as an installation for manufacturing the textile flat body.

Flat bodies of the type in question have many different types of uses, for example as heat insulating panels, sound insulating panels, reinforcing for plastic, filter panels and especially for the manufacture of pile carpet panels.

Pile carpets made from webs or panels have been known for a long time and represent the most widely dispersed type of carpet. The original way of manufacturing pile carpets is manual knotting which today, measured by world wide sales, is still practiced to a diminishing small amount. According to the annular report 1985/1986 of the Society of German Home Textile Industries, e.V., Wuppertal, in Europe for example 2% of all textile floor coverings are still knotted. Somewhat more widely disseminated (Europe=10%) are woven carpets, in the case of which the speed of production can be increased and therefore the price lowered by mechanization of the weaving process. However, the potentials and areas of use for woven carpets are limited, as this and the like is explained in "Von der Faser zum Stoff", L. Adebahr-Dorel 22. Auflage 1972, Verlag Handwerk und Technik, Dr. Felix Buchner, Hamburg, or in "Stoffe 2", Alfons Hofer, 6. Anflage 1987, Deutscher Fachverlag, Frankfurt.

Material consumption especially increases with improved binding of the pile yarns into the basic weaving and the productivity of the manufacturing process diminishes.

Further advances in productivity and indeed today's optimum price-quality relationship have been achieved with the tufting method. In this the pile yarn is stuck through the base textile with hollow needles. The loops which remain on the upperside are either cut to open pile or are left as loops (Boucle). The pile yarns are however, according to thickness, more or less well anchored to the base textile and can despite a rear coating be pulled out of the assembly as individual threads.

The manufacture of tufted carpets is widely practiced and involves 70% of all textile floor coverings in Europe. It takes place predominantly in large band widths of several meters and demands enormous investments for the production equipment for, among other things tufting, cutting, coating and the like. The manufacture of patterned carpets especially demands a large expense in making available different colored threads at each tufting station over the entire width of the carpet. This further involves a large technical expense to select the pile threads, to seize them, to cut them off to the proper length and to insert them into the base textile. The productivity therefore suffers greatly and remains limited to a relatively very low value with a weaving speed of about 200 revolutions per minute.

Essentially lower costs of production are achieved with the needle-felt method, but the resulting carpet quality is not comparable to that of tufted carpets and is therefore given no further consideration here.

In previous decades many efforts have been undertaken to improve the productivity of the tufting process and simultaneously to simplify the design possibilities.

In DE-PS 579482 and GB-PS 472707, using individual threads (yarn bands) and intermediate layers, pile carpets are formed by gluing, which however have only low ruggedness since the pile threads are glued without individual mechanical connection to one another over only a small area. In DE-PS 1071040 a block is formed by the embedding of layers of individual threads in a fastening material, which block is divided into panels by cutting. Here also the ruggedness of the base is too low because of the lack of mechanical connection.

GB-PS 589908 describes the manufacture of pile carpet by means of strips produced by cutting a textile web. In the middle of the strips are warp threads which are applied by gluing or sewing to a lower stratum. The cut weft or woof threads which float free to the left and right of the warp threads are bent upwardly as pile threads and form the visible portion of the carpet whose thickness is determined by the spacing of the strips. Because of involving the troublesome application of the strips to the lower stratum, up to today this process has not yet been put into practice.

A process is described in DE-PS 830042 in which unwoven materials, such as yarns, are pressed into balls, are cut into slices and coated or glued on one of the free surfaces.

In FR-OS 2044778 pile carpets are described whose pile consists of the weft or woof yarns of folded woven webs. The woven webs are folded in zigzag fashion until a block is created. From this successive coated layers are cut off so that the formerly floating woof threads are glued at one end in the coating and so that the other ends form the upper surface of the pile carpet. Here also there fails to be a mechanical anchoring of the pile threads which leads to a low ability of the carpet to resist wear.

The problem of anchoring the pile threads is the subject of CH-PS 401892. Therein the individual pile rows are glued on both sides to band shaped intermediate layers and are thereby joined pile row by pile row to one another. The result is a very stable assembly and a high quality pile carpet.

The method described in CH-PS 52114 applies pole material consisting of fiber bands group wise and perpendicular to band shaped intermediate layers. The fibers are then so cut off that they lie connected to one longitudinal edge of the band and extend upwardly from the other longitudinal edge of the band. Finished pile carpet panels can be obtained by cutting layer by layer blocks consisting of several layers of such pole threads. Disadvantages of this process are on one hand the lack of mechanical anchoring of the pole threads and on the other hand the expensive and complicated positioning of the pole threads on the band shaped intermediate layers.

In CH-PS 546,564 a pile carpet as well as a process for its manufacture is described which seeks to overcome the above described drawbacks. The pile consists in this case of floating weft or woof threads of a woven web whose warp threads are so arranged and the woof threads so interwoven therewith that they later form the basis of the pile carpet. The woven we is coiled (wound up) in an intermediate step and in the next step is first cut up into bands which are so glued to one another that the warp threads come to lie upon one another and form the base of the carpet while the floating woof threads form the carpet pile. As intensive investigations in the meantime have shown a substantial disadvantage of the process of CH-PS 546,564 lies in the fact that wide woven webs are intermediately layered before the gluing so that they during the coiling, the intermediate layering and the following steps of the unwinding and cutting are so deformed that no uniform reproducible pattern can be achieved in the final carpet. This is further aggravated in that the woven web is cut into bands which over their entire lengths have free floating woof threads adjacent one edge area. Through the loose construction of the textile with relatively large stretches of floating woof threads as well as a low number of warp threads the textile is inclined to become quickly distorted so that a successful realization is not possible.

The object of the invention is to provide a textile flat body which can be made simply, economically and with high precision so that it is especially suited for a patterned pile carpet panel, as well as an installation for the manufacture of such textile flat bodies.

Since in that the textile flat body has band segments with two edge sections which are connected with one another by floating woof threads and in that the neighboring edge sections of band segments lying upon one another are not purely mechanically connected with one another, there results a textile flat body of great precision and strength which is suited to the different applications already mentioned above. Especially however it is also suited to the manufacture of pile carpet panels whereby the manufactured pile carpets are distinguished by great precision, high pattern accuracy and high strength.

Especially in the case of a patterning of the flat body requiring high precision, an installation can be realized since in this installation the band manufactured in the weaving or knitting machine, preferably a warp knitting machine, is processed directly to a flat body without intermediate layering. Therefore, the entire course of the manufacturing process from knitting to the manufacture of the flat body can be exactly so controlled that a pattern perfect manufacture and laying up of the band segments in the magazine is possible. By the avoidance of the intermediate layering and the at least partial maintenance of the band tension from the weaving or knitting machine up to the packeting apparatus not only is a high accuracy achieved, but also a high strength, since the woven or knitted edge sections do not have their strength disturbed by an intermediate layering.

Preferred embodiments of the flat body are described hereafter.

The form of the flat body can be of many different shapes with in the simplest form all of the band segments having the same plan form. If the band segments then run parallel to one another flat bodies of constant thickness result. It is however possible that the edge sections of neighboring band segments have some convexity or run convergingly or divergingly, so that corresponding flat bodies are produced which have transverse ribs or which form one side to another increase or decrease in thickness. It is also possible that the band segments have plan forms departing from one another so that in turn a contoured flat body is produced. It is quite possible that the band segments, have between the edge sections at least one further woven or knitted section binding the free floating weft or woof threads. This allows, especially in the case of flat bodies or large thickness, the strength of the flat body to be substantially improved.

On the other hand it is also possible to cut the flat bodies along the middle planes of these additional sections and then again in the middle plane of the floating weft or woof threads so that for example out of one flat body four or more pile carpet panels can be made. The additional woven or knitted section can also especially be of advantage if its hollow space is at least partially filled with a filling material. One such filling material can be flowable, which is particularly advantageous for flat bodies which are to serve as filter elements. On the other hand the filling material can also be solid so that the strength of the flat body is improved, making it suitable for use as a construction element.

The flat body can be patterned in different ways.

Especially advantageous is the manufacture of a floor carpet panel from a flat body of the type embodying this invention wherein the flat body is cut along its main central plane into two pile carpet panels which along with high ruggedness can exhibit an especially high pile thickness and a multiple exact patterning.

The apparatus for manufacturing a flat body is distinguished by a series of separate advantages. That is, since the packeting apparatus is directly connected to the weaving or knitting machine the intermediate layering which would otherwise disturb the structure drops out and makes it possible to make the flat bodies with high precision in a uniform reproducible pattern. By the direct connection of the packeting apparatus the web from the weaving or knitting machine can be held in a controllable constant tension up to the packeting apparatus so that a distortion of the band is hindered or at least made the same for all band segments. A substantially increased periodic exactness therefore occurs which also has a desirable effect on the strength and on the patterning of the flat body.

The web or knitting machine can be so made that individual bands are initially made in the width required for the packeting. Advantageous however is the construction in which a wide web is cut into individual bands, double bands or plural bands. This cutting can take place at different locations in the installation, however preferably it takes place directly adjacent the weaving or knitting location.

A construction of the apparatus with a pressing mechanism is especially practical since by means of the mechanism the connection of the individual band segments can be improved and it can also be assured that the individual flat bodies attain the same thickness. Principally it is possible to arrange the magazine horizontally so that the band segments can be brought together in vertical alignment. Providing a vertically oriented compartment for receiving the band segments is advantageous since the segments are easily arranged in a stack. If the walls of the compartment are heated, the walls promote a rapid drying from a not purely mechanical connection of the band segments.

The band segments can be separated from the band by a severing apparatus before being brought to the magazine. However, the band segments may be severed after they are stacked in the magazine.

The connection of the bands segments to one another can take place in various ways, so that basically the connection can take place in the magazine or later through coating of the rear side of the stack. It is also possible, to make the woof threads and/or the warp threads of thermoplastic materials which are then plasticized by means of a heating device so that band segments neighboring one another are welded together. On the other hand it is also possible to apply a thermoplastic adhesive and to so heat the band segments lying above one another that this adhesive is plasticized and glues the band segments to one another. However, an installation is also possible wherein a liquid adhesive layer is applied by an output device to the edge section of the uppermost hand segment in the compartment of the magazine, with the subsequent band segment being glued to the already brought together ones.

Especially advantageous is an embodiment of the installation wherein by the stiffening of the band at the severing location a wrinkling after the separating is avoided and the uniform structure of the band segments is maintained.

Figure 2:
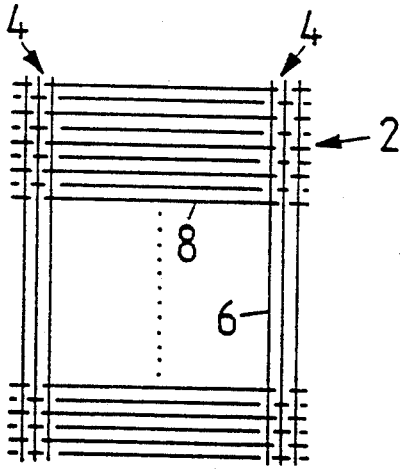
Figure 3:
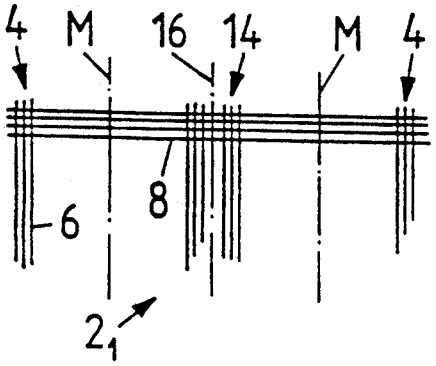
Figure 4:
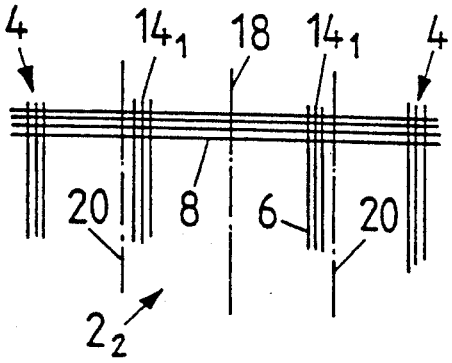
Figure 5:
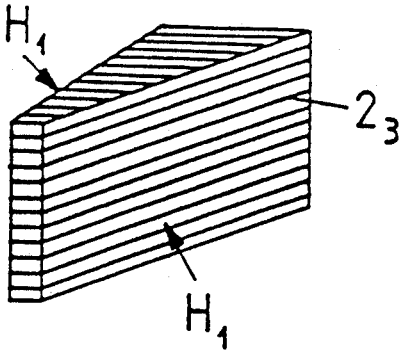
Figure 6:
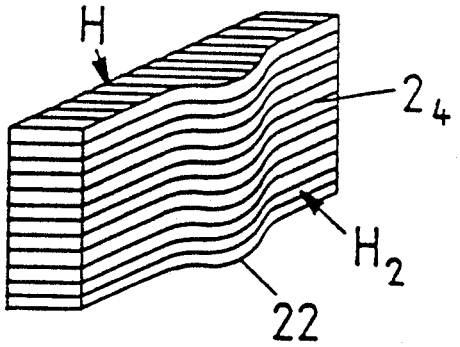
Figure 7:
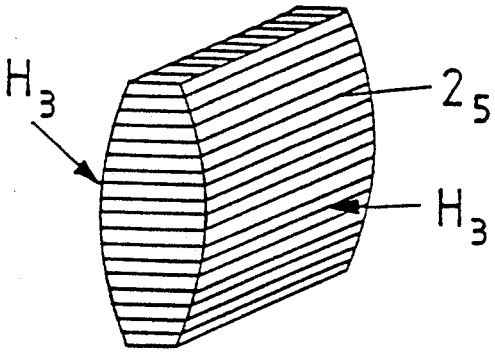
Figure 8:
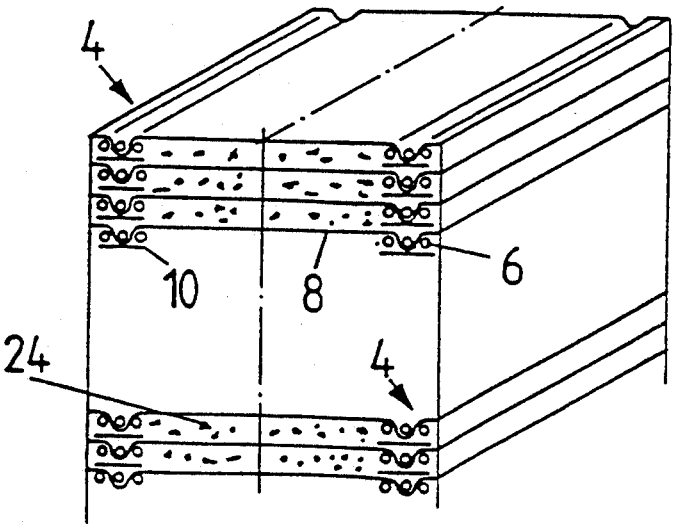
Figure 9:
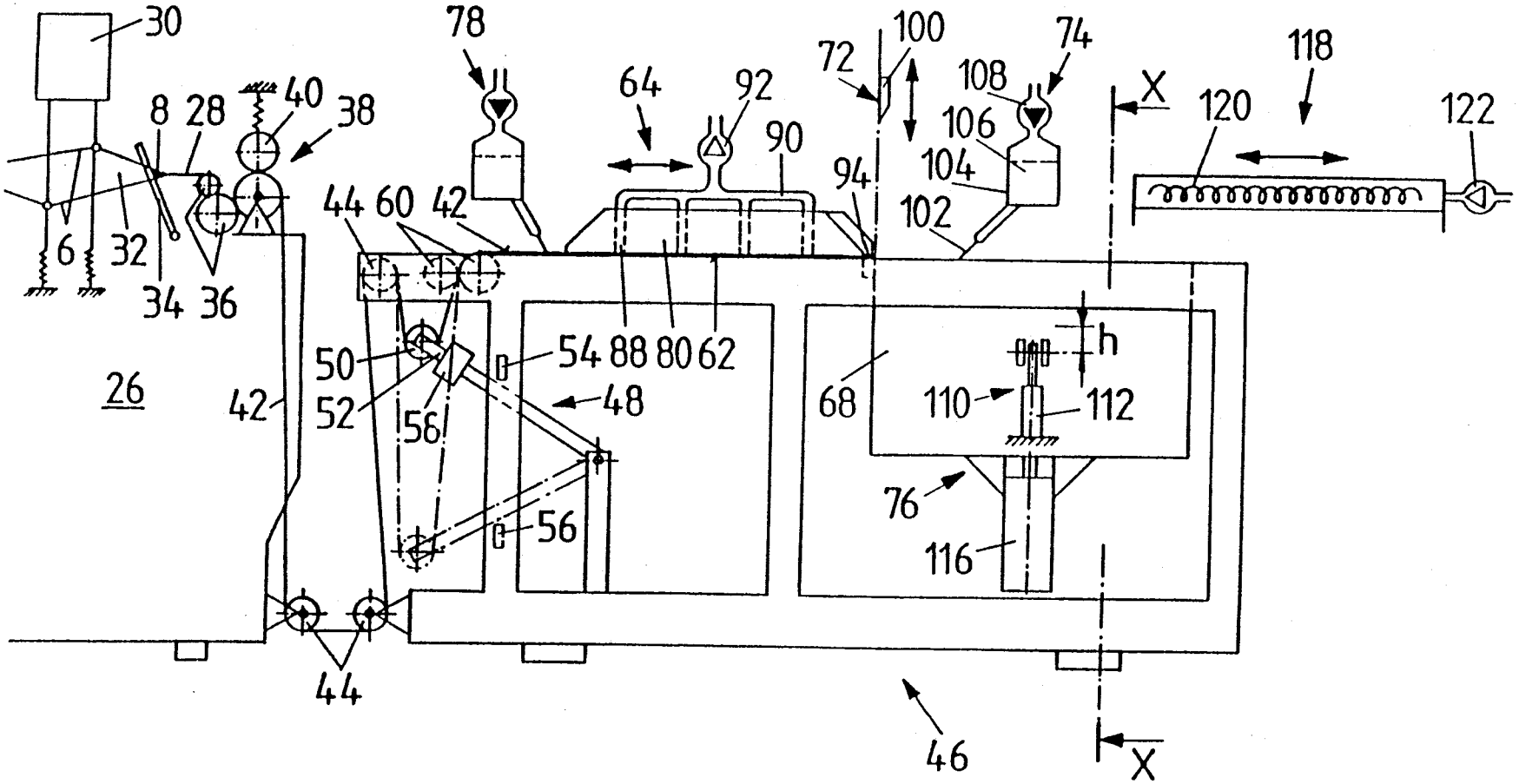
Figure 10:
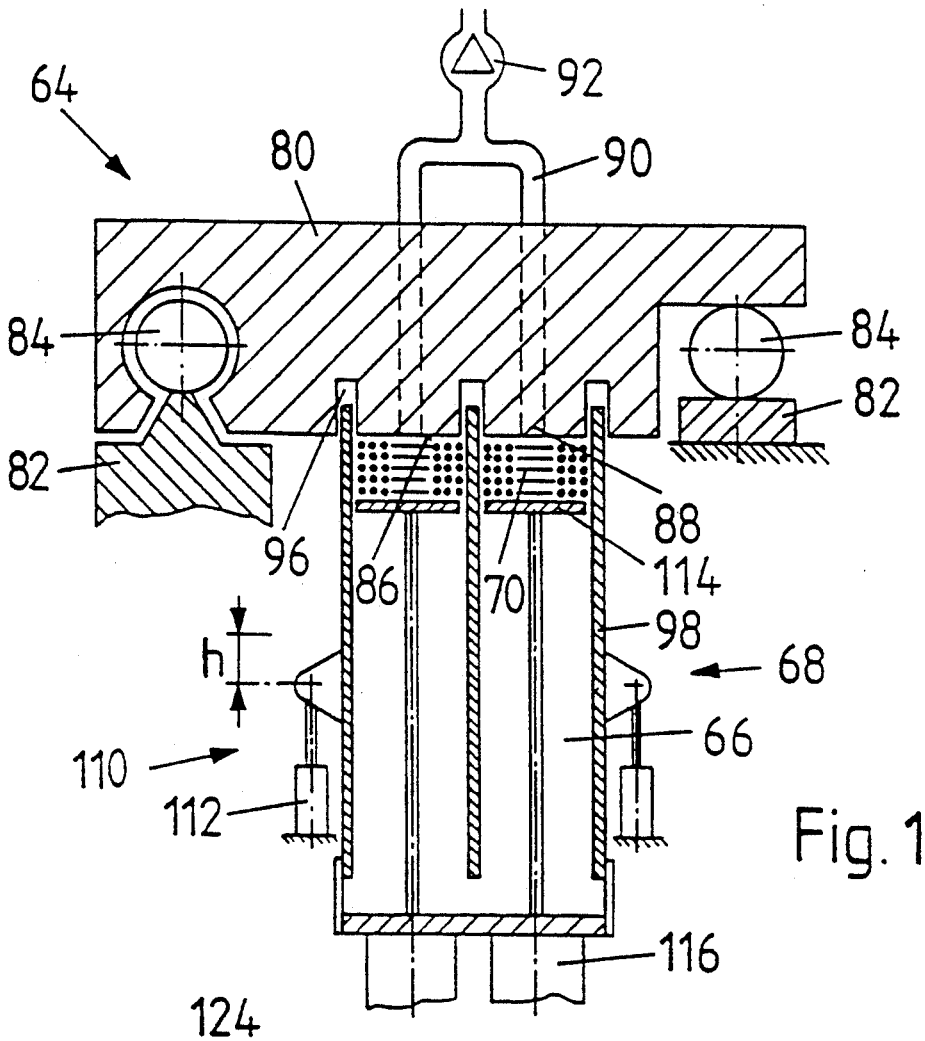
Figure 11:
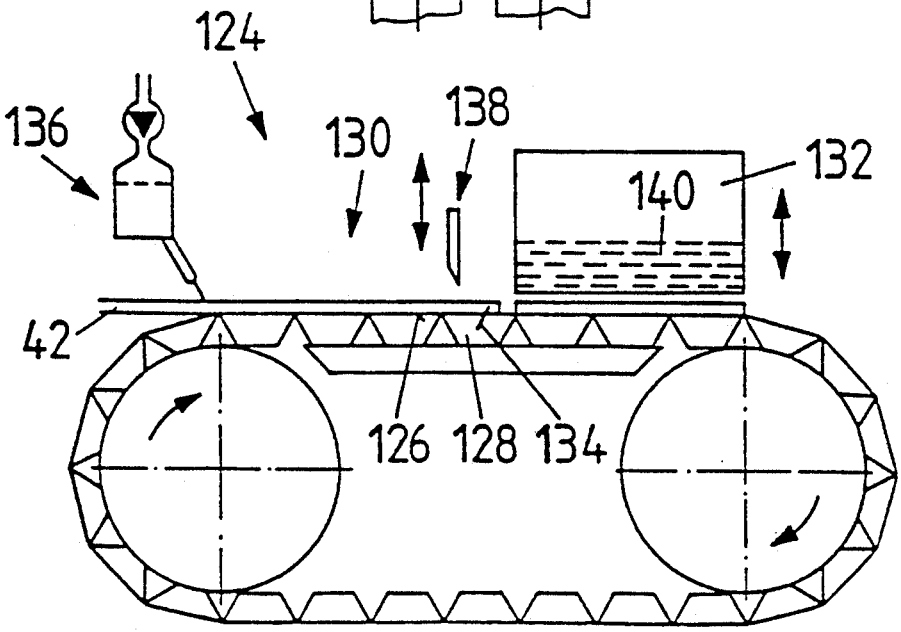
Figure 12:
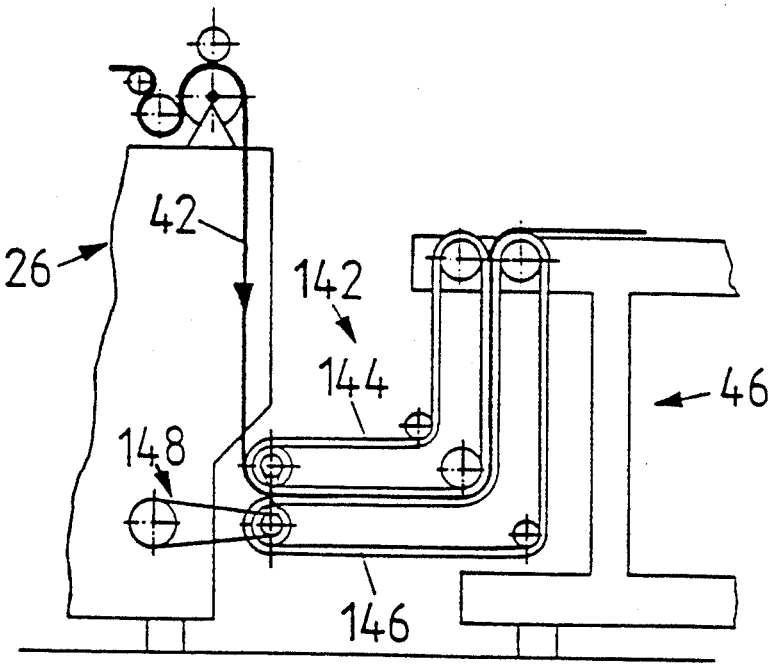

Preferred embodiments of the subject matter of the invention are hereinafter described in more detail in connection with the schematic drawings which show:

FIG. 1 a flat body in perspective view and in section;

FIG. 2 a plan view of a band for manufacturing the flat body of FIG. 1;

FIG. 3 a plan view of a band segment with three woven or knitted sections;

FIG. 4 a plan view of a band section with four woven or knitted sections;

FIG. 5 a perspective view of a flat body with conical cross section;

FIG. 6 a perspective view of a flat body with a rib-like bulge;

FIG. 7 a perspective view of a concave flat body;

FIG. 8 a perspective view of a flat body with a filling material;

FIG. 9 a side view of an installation for manufacturing the flat body;

FIG. 10 a section along the line X—X of FIG. 9 showing the transfer apparatus and the magazine;

FIG. 11 a side view of a further embodiment of the transfer apparatus and of the magazine;

FIG. 12 a transport apparatus between the weaving machine and the packeting or stacking apparatus.

FIG. 1 shows a textile flat body, in a sectional and perspective representation, having a length L, a width B, and a thickness D. The flat body is made of individual band segments 2, which in FIG. 2 are shown in plan view. These band segments consist of marginal sections 4 in which warp threads 6 are woven or knitted with weft or woof threads 8. The woof threads float between the marginal sections 4. These band segments 2 are laid over one another in the form of a stack and at the marginal sections 4 are connected with one another in more than a purely mechanical way. This connection can take place either through a layer of adhesive 10 arranged between the marginal sections of neighboring band segments 2, as illustrated in FIG. 1, and/or through a thermal welding of the warp threads and/or the woof threads if these are made of thermoplastic material and/or through the coating or impregnating of the main surfaces H with a binding material. The band segments lie perpendicularly to the main center plane M and the main faces H of the flat body.

The textile flat body of the type illustrated in FIG. 1 can be used directly as an insulating panel against the transmission of heat or sound, as a filter plate, as armoring for plastic and for similar applications. From one such flat body two mirror image symmetrical pile carpet panels of outstanding quality can be made by cutting through the luxuriant woof threads 8 longitudinally of the main central plane M.

FIG. 3 shows a further band $2_1$, in which the floating weft or woof threads between the marginal sections 4 in their middle portion have a section 14 at which the woof threads 8 are woven or knitted with further warp threads 6. Such a band $2_1$ can in turn be used for the manufacture of a flat body in which higher strength is achieved through the middle section 14. One such flat body can however, by severing along the separation plane 16, also be divided into two flat bodies of the type illustrated in FIG. 1. These in turn can be used directly or in the previously mentioned manner can be divided into pile carpet panels by severing along the main central planes M.

FIG. 4 shows on the other hand, as a further example, a band segment $2_2$ in which next to the knitted or woven marginal sections 4 two additional sections $14_1$ are provided at which the woof threads 9 are woven or knitted with the warp thread 6. The flat body made from these band segments $2_2$ can also be used either directly or can be cut into four pile carpet panels by severing the flat body made from the band segments $2_2$ along its middle plane 18 as well as along two further planes 20 which directly border on the sections $14_1$ and specifically on the sides turned to the edge sections 4.

FIGS. 5, 6 and 7 show flat bodies of different profile. The flat body of FIG. 5 has tapered main faces $H_1$ and is formed of band segments $2_3$ of identical plan shape. The flat body of FIG. 6 has on one main face $H_2$ a rib-like convexity 22 and is formed of identical correspondingly shaped band segments $2_4$.

The flat body according FIG. 7 has bulged main faces $H_3$ formed thereon and is so formed that the band sections $2_5$ laying on one another run so as to first widen to the largest thickness of the body and to then subsequently diminish in width.

FIG. 8 shows a further flat body which is built analogously to the flat body of FIG. 1 wherein however the hollow spaces between the floating woof threads 8 are filled with a filling material 24. One such filling material 24 can be example have filtering properties such as is the case for activated charcoal. Such a flat body is suited for use as a filter element.

FIGS. 9 and 10 show an apparatus for manufacturing a flat body. This installation contains a machine 26 which in the present example is made as a weaving machine and serves for the manufacture of a woven web 28. The weaving machine 26 is of usual construction. A partition forming device 30 lifts and lowers the warp threads 6 for forming a weaving partition 32 through which one woof thread 8 is carried. A weaving reed 24 serves for striking the woof threads 8. The woven web 28 so formed is guided over several rolls 36 to a cutting device 38 which by means of a cutting knife 40 cuts the woven web 28 into individual bands 42 for example of the type illustrated in FIG. 2. From the weaving machine 26 the bands 42 are delivered to a packeting apparatus 46 over diverse guide rolls 44. Between the weaving machine 26 and the packeting or stacking apparatus 46 is a tension device 48 which provides for an at least nearly uniform band tension from the weaving machine 26 to the packeting apparatus 46 so that the band tension in the packeting apparatus is at least a fraction, for example half, the band tension in the weaving machine.

The tension apparatus 48 include a dancer roll 50 fastened to a swinging arm 52 which cooperates with limit switches 54, 56. The limit switches 54, 56 serve to control the installation. If for example the upper limit switch 54 is actuated by the swinging arm 52 either the speed of the packeting apparatus 46 is lowered or the speed of the weaving machine 26 is increased. On the other hand, if the swinging arm 52 moves against the lower limit switch 56, this indicates a too great supply movement for the band 42. Accordingly, the actuation of the limit switch 56 works in the opposite sense to effect a reduction in the speed of the weaving machine 26 or an increase in the speed of the packeting apparatus 46. The swinging arm 52 is so adjusted by a weight 58 or a spring that the bands 42 are always held under constant tension. Moreover, the dancer roll 50 serves as an intermediate store for the taking up of the bands 42 continually produced by the weaving machine 26, which bands are taken up by the packeting machine 46 in step fashion.

The packeting apparatus 46 has driven delivery rolls 60 working against one another which grip the bands and move them to a support table 62 from which they are grasped by a transfer device 64 and segment wise transferred into compartments 66 of a magazine 68 and stacked over one another into packets 70. A severing mechanism 72 associated with the magazine 68 serves for severing the band segments from the bands 42. A mechanism 74 is further provided for connecting the band segments in the magazine. A press mechanism 76 serves to press the packets 70 made of the band segments 2 in the magazine 68. An apparatus 78 serves to stiffen the bands 42 at the severing station provided for severing the band segments 2 from the bands 42.

The transfer apparatus 64 has a body 80 moveable back and forth on rails 42 and ball bearings 84 between the receiving station in front of the magazine 68 on the support table 62 and the magazine 68. The body includes on its bearing surface 86 different vacuum openings 88 connected with a pump 92 by vacuum ducts 9. Additionally, the body 80 includes needles 94 which stick into the bands to serve as carriers. Further, the body is provided with groove 96 in which the walls 98 of the magazine bordering the compartments are received during pressing of the packets 70, as explained in more detail below.

The severing mechanism 72 contains a knife 100 moving up and down which operates when the transfer apparatus 64 has brought the band 42 into the magazine. The severing apparatus 72 can be adjusted in a non-illustrated way in the direction of the bands to adjust the length of the band segments deposited in the magazine.

The magazine 68 is further associated with the mechanism 74 for binding the band segments 2. The apparatus 74 contains jets associated with the marginal sections 4 of the band segments 2, which jets are connected with a pressure container 104 and from which jets adhesive 106 is applied to the marginal sections in the form of beads by a pump 108. The apparatus 74 passes over the band segments synchronously with the movement of the body 80 of the transfer apparatus 64 so that immediately before the bringing of a band or band segment to the magazine the uppermost laid up band segment is provided with a bead of adhesive.

As already mentioned above, the magazine contains a press device 76 for binding freshly brought band sections with the packets 70 in the compartments 66 of the magazine 68. For this purpose the magazine 68 includes lifting devices 110 which raise and lower the compartments 66. The lifting devices 110 are, for example, pneumatically or hydraulically actuated piston/cylinder devices 112. In the lowered condition the apparatus 74 can on one hand be driven to apply the adhesive and on the other hand the body 80 of the transfer apparatus 64 can be driven over the magazine and the laid up packets in the magazine. As soon as the body 80 is over the magazine 68 the lifting apparatus 110 lifts the magazine so that the walls 98 of the compartments 66 are received in the grooves 96 of the body 80 so that the delivered band segments are pressed to the packets 70. Irrespective of the lifting apparatus 110 the pressing pressure is determined by a yieldable floor 114 in each compartment 66 connected to a piston/cylinder device 116 which delivers a measured counterpressure and effects a corresponding lowering of the floor upon an increase of the pressure beyond a given amount. The counterpressure can also be created in that the width of the compartments is slightly smaller than the width of the band segments so that these are pinched as they are moved into the compartments.

The body 80 and/or walls 98 of the compartments 66 can be provided with a non-illustrated heating apparatus to accelerate the hardening or drying of the adhesive. It is, however, also possible to move an additional heating apparatus 118 over the compartments 66 of the magazines 68 when the body 80 of the transfer apparatus 64 is returned to the receiving position over the support table 62. The heating apparatus 118 contains a heat helix 120 and a blower 122 by means of which hot air can be blown into the packets 70 in the magazine 68. This apparatus can, if need be, contain severing knives to serve as substitutes for the severing apparatus 72 for severing the band segments 2 from the bands 42.

The apparatus 76 for stiffening the bands at the severing station is made analogously to the apparatus 74 for connecting the band segments, with the stiffening apparatus 78 however applying an adhesive over only a small area of the band.

FIG. 11 shows a further embodiment of a packeting machine 120 in which the support table 126 consists of a circulating belt 128 which simultaneously also forms the transfer apparatus 130 for transferring the band segments to the magazine 132. The band 128 contains carrier pins 134 which grip the bands 42 and moves them past and below a mechanism 136 for applying an adhesive to them and to a severing apparatus 138, which cuts band segments 2 of desired length from the bands 42. Thereafter, the conveyor belt 128 conveys the band segments 2 under the magazine 132. Through lowering of the magazine 132 the band segments on the conveyor belt 128 are captured and simultaneously are pressed to the packets 140 in the magazine 132. Upon raising of the magazine 132 the band segments 2 are taken from the conveyor belt 128.

FIG. 12 shows a transport apparatus 142 arranged between the weaving machine 28 and the packeting apparatus 46 which is made of two transport belts 144, 146 lying against one another and between which the band 42 is so arranged that a stretching of the band 42 is hindered. In this connection, the transport belts are driven through a suitable drive 148 in synchronism with the weaving machine 26.

Still many further embodiments are imaginable. Especially in place of the apparatus for applying the adhesive an apparatus can be used wherein bands and band segments which contain thermoplastic threads are heated to such a temperature that the thermoplastic threads melt and weld to one another.

The flat bodies made by the installation can either be used as end products or by means of the previously mentioned severing along the main middle planes can be divided into pile carpet panels.

REFERENCE NUMBER LIST

B Width
D Length

H Main surface
$H_1$ Main surface
$H_2$ Contoured main surface
$H_3$ Bulged main surface
L Length
M Main central plane
2 Band segment
$2_1$ Band segment
$2_2$ Band segment
$2_3$ Band segment
$2_4$ Band segment
$2_5$ Band segment
4 Band segment
6 Warp thread
8 Woof thread
10 Adhesive layer
14 Section
$14_1$ Section
16 Separation plane
18 Central plane
20 Plane
22 Rib-like convexity
24 Filling material
26 Weaving machine
28 Woven web
30 Partition forming apparatus
32 Weaving partition
34 Weaving reed
36 Roll
38 Cutting device
40 Cutting knife
42 Band
44 Guide roll
46 Packeting apparatus
48 Tension apparatus
50 Dancer roll
52 Swinging arm
54 Limit switch
56 Limit switch
58 Weight
60 Delivery Roll
62 Support table
64 Transfer device
66 Compartment
68 Magazine
70 Packet
72 Severing mechanism
74 Connecting mechanism
76 Press mechanism
78 Stiffening apparatus
80 Body
82 Rail
84 Ball bearing
86 Bearing surface
88 Vacuum openings
90 Vacuum duct
92 Vacuum duct
94 Carrier pins
96 Groove
98 Wall of 66
100 Knife of 72
102 Jet
104 Pressure container
106 Adhesive
108 Pump
110 Lifting device
112 Piston/cylinder device
114 Floor
116 Piston/cylinder device
118 Heating apparatus
120 Heat helix
122 Blower
124 Packeting apparatus
126 Support table
128 Conveyor belt
130 Transfer apparatus
132 Magazine
134 Carrier pins
136 Mechanism
138 Severing apparatus
140 Packet
142 Transport apparatus
144 Transport belt
146 Transport belt
148 Drive

We claim:

1. A flat textile body comprising: band segments lying upon one another and arranged perpendicular to the main central plane of the body, with each band segment having woven or knitted edge sections made from warp threads and weft threads, between which edge sections the weft threads extend with at least a major portion of each thread floating, and with the edge sections of the neighboring band segments lying upon one another and being connected with one another.

2. A flat body according to claim 1 further wherein all band segments have the same plan shape.

3. A flat body according to claim 1 further wherein the band segments of neighboring band segments have plan shapes which depart from one another.

4. A flat body according to claim 1 further wherein each band segment between the edge sections has at least one further woven or knitted section bound with the floating weft threads, with the further sections of neighboring band segments being connected with one another.

5. A flat body according to claim 1 further wherein the body includes weft threads of different materials and/or different colors which are arranged to form a pattern.

6. A flat body according to claim 1, further wherein the body has a variable thickness in a dimension extending parallel to the band segments.

7. A flat body according to claim 1 ,further wherein the body has hollow spaces at least partially filled with a filtering material.

8. A textile flat body as defined in claim 1 wherein the band segments are connected with one another by non-mechanical means.

* * * * *